US010049566B2

(12) United States Patent
Shanahan

(10) Patent No.: US 10,049,566 B2
(45) Date of Patent: Aug. 14, 2018

(54) SYSTEMS AND METHODS FOR INTRA-VEHICLE PEDESTRIAN AND INFRASTRUCTURE COMMUNICATION

(71) Applicant: Michael E. Shanahan, Palisades, NY (US)

(72) Inventor: Michael E. Shanahan, Palisades, NY (US)

( * ) Notice: Subject to any disclaimer, the term of this patent is extended or adjusted under 35 U.S.C. 154(b) by 0 days.

(21) Appl. No.: 15/448,562

(22) Filed: Mar. 2, 2017

(65) Prior Publication Data

US 2017/0256147 A1 Sep. 7, 2017

Related U.S. Application Data

(60) Provisional application No. 62/389,571, filed on Mar. 2, 2016.

(51) Int. Cl.

| | |
|---|---|
| ***G08G 1/00*** | (2006.01) |
| ***G08G 1/005*** | (2006.01) |
| ***G08G 1/01*** | (2006.01) |
| ***G08G 1/0967*** | (2006.01) |
| ***G08G 1/16*** | (2006.01) |

(52) U.S. Cl.

CPC ..... *G08G 1/00* (2013.01); *G08G 1/005* (2013.01); *G08G 1/0112* (2013.01); *G08G 1/0133* (2013.01); *G08G 1/0141* (2013.01); *G08G 1/096716* (2013.01); *G08G 1/096741* (2013.01); *G08G 1/096775* (2013.01); *G08G 1/162* (2013.01); *G08G 1/164* (2013.01)

(58) Field of Classification Search

CPC ..... G08G 1/00; G08G 1/005; G08G 1/0112; G08G 1/0133; G08G 1/0141; G08G 1/096716; G08G 1/096741; G08G 1/096775; G08G 1/162; G08G 1/164

See application file for complete search history.

(56) References Cited

U.S. PATENT DOCUMENTS

| | | | | |
|---|---|---|---|---|
| 2015/0035685 | A1* | 2/2015 | Strickland | B60Q 9/008 340/901 |
| 2015/0070131 | A1* | 3/2015 | Beaurepaire | G08G 1/005 340/5.8 |
| 2015/0127570 | A1* | 5/2015 | Doughty | G06Q 50/265 705/325 |
| 2015/0145695 | A1* | 5/2015 | Hyde | G06Q 40/08 340/905 |
| 2017/0156042 | A1* | 6/2017 | Kwan | H04W 4/22 |

* cited by examiner

*Primary Examiner* — Leon Flores

(74) *Attorney, Agent, or Firm* — Michael Shanahan, Esq.

(57) ABSTRACT

Systems and methods are provided for improved pedestrian and vehicle safety along with systems and methods for obtaining or sharing data from surrounding mobile assets in the case of an occurrence of an event of interest, an impending event of interest or emergency situation.

25 Claims, 5 Drawing Sheets

SYSTEMS AND METHODS FOR INTRA-VEHICLE PEDESTRIAN AND INFRASTRUCTURE COMMUNICATION

RELATED APPLICATION

This application claims the benefit of U.S. Provisional application No. 62/389,571, filed on Mar. 2, 2016 which is hereby incorporated by reference in its entirety.

BACKGROUND

Occupants of vehicles such as cars, motorcycles, aircraft, boats or the like have a need to communicate directly with one another while driving. For example, a driver of a nearby or adjacent vehicle may wish to pass that vehicle, advise the other driver of an unsafe condition such as low tire pressure, vehicle malfunction and other safety concerns. Law enforcement or others may also wish to communicate with vehicle operators while driving for a variety of reasons. Further, it may be desirable to record and store visual images, such as video, audio and other data through cameras or other image capture devices to record and provide periodically such information for use in various applications such as safety, traffic management, law enforcement and the like.

Mobile peer to peer communication is well known. Cell phone users can contact each other directly through voice, email or text communication. However, in the driving environment, with unknown users in proximity to one another, no such system currently exists.

Further, systems and methods for effective and safe travel are also desirable. One such technology includes collision detection/avoidance, and involves breaking and/or selective maneuvering to avoid collision. Such prior art systems include incremental breaking at certain inflection points to avoid other vehicles, which may include sensed obstacles such as pedestrians (e.g., collision avoidance V2V or V2P technologies).

Further, there are well known techniques in the art to detect a risk of collision or other incident between a vehicle and another vehicle, pedestrian, or stationary object. A survey of some of those methods is provided in a technical report by Alberto Martin et al, "INTELLIGENT VEHICLE/HIGHWAY SYSTEM: A SURVEY", Department of Mechanical Engineering Miami, Fla., incorporated herein by reference in its entirety. Some of those techniques rely on in-vehicle sensing, other techniques supplement in-vehicle sensing with vehicle-to-vehicle and vehicle-to pedestrian and vehicle-to-infrastructure communication (see, for example, paper by "Cloud-Based Pedestrian Road-Safety with Situation-Adaptive Energy-Efficient Communication", Mehrdad Bagheri; et al, IEEE Intelligent Transportation Systems Magazine, Year: 2016, Volume: 8, Issue: 3, Pages: 45-62, incorporated herein by reference in its entirety).

SUMMARY OF THE INVENTION

It is therefore an object of the present invention to provide systems and methods for improved pedestrian and vehicle safety.

It is a further object of the present invention to provide systems and methods for obtaining or sharing data from surrounding mobile assets in the case of an occurrence of an event of interest or an impending event of interest.

It is a further object of the present invention to provide systems and methods for detecting and improving traffic management based on sensed mobile asset interaction.

It is a further object of the present invention to provide systems and methods for providing adaptive warnings schemes for mobile assets that take into account situational variables and/or user operating tendencies.

It is a further object of the present invention to provide systems and methods for detecting and confirming an event of interest, such as a collision, has occurred.

It is a further object of the present invention to provide systems and methods for communication between various mobile assets.

It is also an object of the present invention to provide systems and methods for selectively shifting transmission gears in a vehicle in response to an impending forced braking event.

These and other objects of the present invention are accomplished by providing systems and methods that provide improved pedestrian and vehicle safety and further provide systems and methods for obtaining or sharing data from surrounding mobile assets in the case of an occurrence of an event of interest or an impending event of interest. In one embodiment of the present invention, a system for determining whether one or more mobile assets have been involved in a collision is provided, comprising a wireless network configured to receive a collision detection message from a plurality of mobile assets, wherein the wireless network receives a first collision detection message from a first mobile asset and a second collision detection message from a second mobile asset and comparing the first collision detection message and the second collision detection message to determine whether the first mobile asset and second mobile asset have likely collided.

In another embodiment of the invention, a system for use with a plurality of mobile assets to acquire potentially relevant information regarding an event of interest is provided comprising a wireless network configured to monitor wireless assets within a predetermined area, the wireless network further configured to determine when an event of interest occurs within the predetermined area; the wireless network configured determine a sub-plurality of mobile assets from the plurality of mobile assets proximate to the event of interest; the wireless network further configured to determine if any of the sub-plurality of mobile assets has potentially relevant information regarding the event of interest; and the wireless network configured to upload any potentially relevant information identified from the sub-plurality of mobile assets.

In another embodiment of the invention, a system for use with a plurality of mobile assets to assist in the safe exit of a venue in the event of an emergency situation, is provided, comprising a wireless network configured to monitor a plurality of wireless assets within a predetermined area, the wireless network further configured to determine when an emergency event occurs within the predetermined area; the wireless network configured to determine a sub-plurality of mobile assets potentially affected by the emergency event; and automatically providing an egress route to the mobile device to provide assistance for users of the sub-plurality of mobile assets to safely exit the venue.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTIONS

Figure 1:
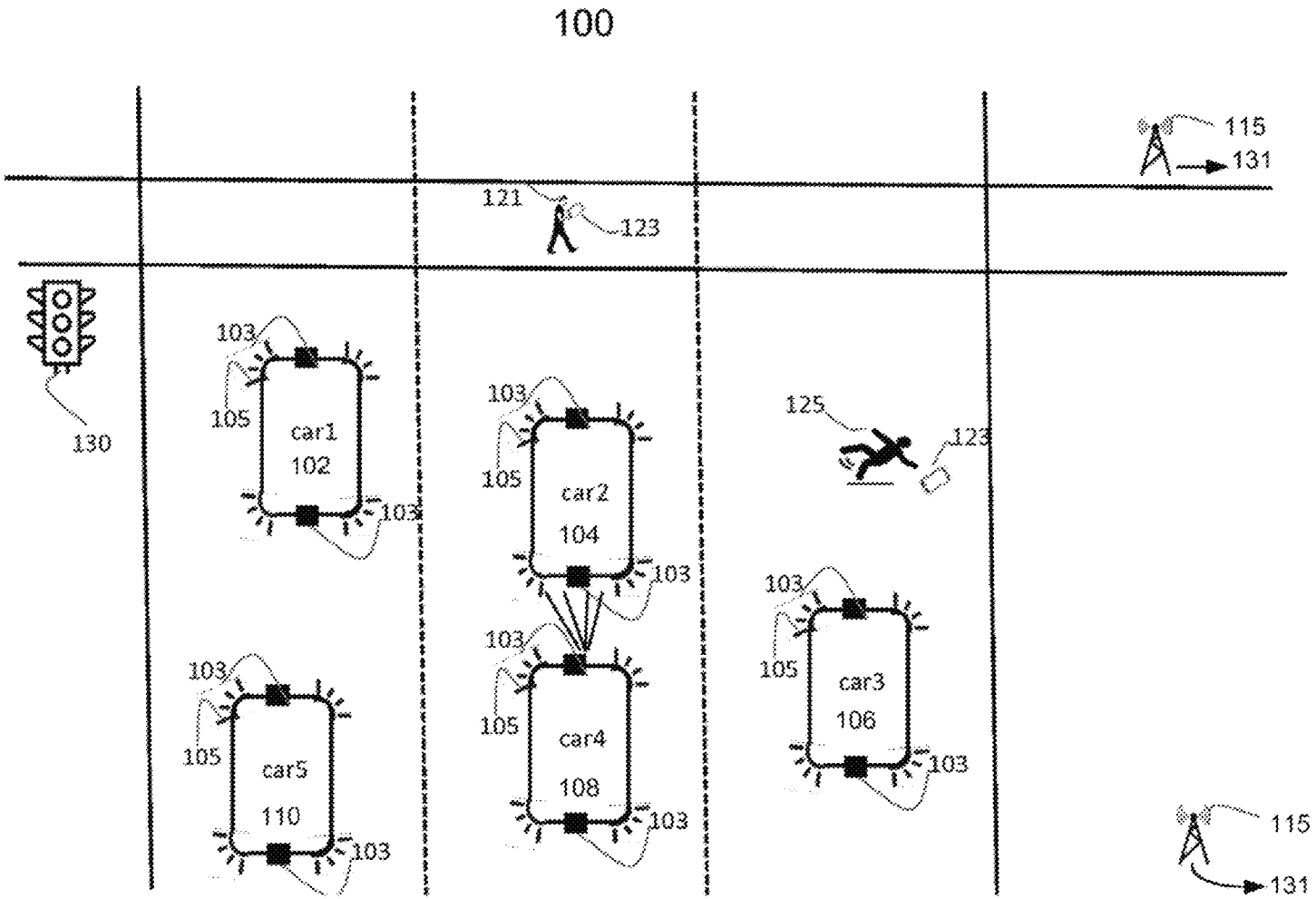
FIG. 1 is a generalized diagram of a system for providing improved pedestrian and vehicle safety and further provide systems and methods for obtaining or sharing data from surrounding mobile assets in the case of an occurrence of an event of interest or an impending event of interest in accordance with one embodiment of the present invention.

One aspect of the invention is concerned with providing occupants or operators of vehicles with a way to communicate with each other and other and nearby vehicles. This may be accomplished by a communication link between nearby vehicles through an interface environment that allows vehicle occupants to communicate substantially directly with one another through text video and/or audio messages (the "Intelicom System"). This may be accomplished through any suitable wireless communication link such as a cellular or Wi-Fi link V2V, V2P link and the like. In some embodiments, this may include VANET and MANET type networks, Direct Short Range communications networks (DSRC) and communications occurring in the 5 Ghz-6 Ghz range or as otherwise mandated by the National Transportation Safety Board (NTSB) or other traffic or law enforcement authority. Such transmitter and/or receiver and/or transceiver links may be installed in a vehicle such as a car, truck, motorcycle, aircraft or boat or in a mobile device such as a mobile phone associated with a pedestrian as further described herein. In operation, such links may become active when the vehicle is in operation or as selectively employed or activated by vehicle occupants or by remote control or request as further described herein.

In operation, a vehicle, for example, may be driving on a highway or road. The communication links may automatically recognize other nearby vehicles through the communication link(s) described above or other means such as through RFID tags or other passive or active transponder and populate a user interface showing those nearby vehicles. Such information may be supplemented, provided or distributed by the cloud to provide more detailed information regarding the surrounding vehicles.

In some embodiments, users may selectively engage the system to participate in communications or may disable some or all parts of the system, including telemetry and other sensors while in "privacy" mode. The interface may indicate if those vehicles may be communicated with (e.g., are "active") or are not participating. Display or transmission of some information (public or not) may be mandatory depending upon local law. Failure to comply with such regulations may result in law enforcement or traffic control scrutiny. A user of the vehicle may then select one of the vehicles on the list and choose to communicate with the other vehicle through the user interface and communications link. A list of assets encountered while traveling may be compiled and stored in a control module of the vehicle and/or transmitted to the cloud. The user may also obtain conventional communication information through the interface such as the selected vehicles' or occupants' cell phone number or email address or other contact information which may be "published" or made public to establish contact as further described herein through those means using this system or mobile device based system.

Further, in some embodiments, the user communications interface may be provided, hosted or ported in/to and/or from a mobile communication device of the driver or an occupant such as a mobile phone or tablet interface which may be in the form of a communications application ("app") obtainable through an online application vendor. In such cases, the interface may be resident on the mobile device and ported to a display screen resident in the vehicle, or, may reside on the mobile device. The mobile device may communicate with the vehicle through any suitable communication link such as a hard-wired link wireless Bluetooth, WiFi, or cellular link or the like.

For example, after selecting a recognized or desired nearby vehicle, the call initiator may send a text-based message, initiate a two-way (or one-way) voice communication such as a phone call or a two-way or one way video communication with occupants of the selected vehicle. Certain messages such as text based messages may be pre-composed so the vehicle occupants, such as the vehicle operator or driver, does not write such messages at the time of communication. In this way, a two-way, (or at least one-way, which may confirm delivery of message) communication link with nearby vehicles may be established. This allows vehicle occupants to communicate with one another without having pre-existing conventional contact information. Such messaging applications may be hosted through a pre-existing interface in a user mobile device. Such messages may include law enforcement or traffic messages such as speed warnings, direct communication with law enforcement or traffic control on safety or other issues such as weather-related and congestion messages.

In the case where the contact is audio and or video, a suitable camera and/or microphone may be installed in the vehicle cabin or resident on the mobile communication device to allow adequate acquisition and transmission of audio and/or video communication. This may include an image of the driver, occupant or other user-selected image. This may be streamed or selectively transmitted via VANET, MANET or any suitable other interconnection.

Further, in accordance with another aspect of the invention, cameras and/or other sensors may be installed/present in the front and/or rear or in the "four corners" on the outside of the vehicle to allow a substantially 360-degree (or less, e.g., 180 degree depending on desired coverage area) view of the surrounding area. Such sensors may be adjustable or moveable in orientation to change viewing area and resolution and sensitivity may be variable/adjustable as well depending on data acquisition goals (adjustable magnification, fish-eye/panoramic type view, long or short range for improved or lesser sensitivity, etc.). Changes in such parameters may be dynamic based on remote (cloud) requests or in accordance with "in-asset" data management protocols.

In operation, such cameras/sensors may become active when the vehicle operates such that surrounding areas are recorded for a predetermined period of time (e.g., 15 minutes, an hour etc.). This period of time may be preselected, set by a user, a system manufacturer or set by traffic control authority when a vehicle enters a certain area and may be determined or influenced by memory constraints of the system. It may also be influenced based on driving conditions, anticipated route, safety setting of the vehicle (e.g., new or less proficient or historically less safe driver may be accorded more liberal recording/warning schemes) and may also adaptively and/or dynamically select certain types of sensors that may be available in addition to cameras (e.g., infrared (IR), radar laser, etc.) in order to achieve certain data acquisition goals or to comply with regulations.

For example, the vehicle manufacturer, user, or traffic control authority may select radar and IR sensors in addition to cameras in poor visibility and/or bad weather conditions such as rain or snow to obtain desired information regarding the surroundings. Thus, the vehicle provides/has a sensor record (visual and/or audio and/or telemetry data record) of the vehicle's travels including the surrounding area that can be accessed at a later time or based on a remote call or request to access that information in real-time or near real-time through certain communications links (e.g., V2I V2V, V2P (MANET VANET, DSRC, etc.).

Similarly, the sensitivity, direction and activation (which cameras/sensors are active) of various sensors may be preselected, set by a user, a system manufacturer or set by traffic control authority when a vehicle enters a certain area and may be determined or influenced by memory constraints of the system. It may also be influenced based on driving conditions and may also adaptively and/or dynamically select certain types of sensors that may be available in addition to cameras (e.g., infrared (IR), radar, laser, etc.)

In some embodiments, camera(s), microphones, laser, radar or other relevant vehicle sensors may also be active/activated and operational as described above when the vehicle itself is not in active operation (e.g., parked, parked with ignition off). Activation of one or more sensors in such non-active vehicle(s) may be based on a remote request from the cloud (e.g., traffic authority), a remote operator, a vehicle owner or such activation may occur periodically as specified or predetermined by a user, manufacturer or other party such as a vehicle rental company in order to acquire such information absent a specific contemporaneous request for such information.

Such functionality may be generally desirable itself and particularly desirable in the case where an incident of interest occurs near a non-operating asset/vehicle(s) (e.g., a parked car) and video, images, audio and/or other telemetry is desirable.

In some embodiments, a network may determine mobile assets proximate to an event of interest (e.g., vehicle, pedestrian). For example, an accident, crime scene, other notable or newsworthy event, etc. This may be accomplished in numerous ways. In one embodiment, location of a vehicle or other mobile asset's location may be periodically reported to the cloud or network. In this case, server-side logic in the network may determine what assets are proximate to the area of interest as defined by network or standard, which may be adaptive/dynamic depending on an identified event(s) of interest. The definition of an event of interest may be determined by a network application, traffic control or law enforcement authority and may be dynamic in nature.

Further, the determination of what constitutes a proximate area may vary based on preselected criteria such as perceived importance, or other data acquisition goals. For example, certain minor or short-lived time sensitive incidents such as a low-impact V2P collision may be afforded a certain (smaller) proximate area whereas a larger, more important, or less time sensitive incident, such as a building fire, plane crash, large accident, etc., may be afforded a wider proximate area (bearing in mind the safety, mobility, willingness and availability of the mobile asset to assist or acquire data).

In operation, the network may initiate communication such as a handshake with assets within the proscribed radius of the incident to confirm their position and data acquisition capability in order to obtain/provide/preserve information of interest that asset may have or may be able to acquire.

In another embodiment, network-based server-side logic may have limited and/or outdated information about the position of vehicles and other assets. If an event of interest occurs, the server-side logic may send a message (e.g., a broadcast call, push message, or cloud to device message) to a larger group of vehicles/mobile assets in a wider area relatively close to the event. Such a message may contain coordinates and optionally other particulars regarding the event of interest (e.g., description of incident, what is involved, etc.). Vehicles/mobile assets that are beyond a certain response range (e.g., a predefined threshold range), may ignore such messages or provide a negative response. Assets within the threshold region (e.g., closer proximity) may positively respond (in some embodiments, such response may depend on privacy settings and/or authorization of the request message, by electronic signature or user confirmation, etc.), and the server side logic and vehicles/mobile assets may further communicate to obtain/provide/preserve the requested or other relevant information.

In some instances, a network and/or an in-vehicle control module may determine the proximity of a vehicle to an event and issue a request to initiate data acquisition operations (e.g., acquire video, audio, radar, infrared measurement, laser (e.g., time of travel distance measurement) etc.). In some embodiments, the remote request may specifically activate and/or control certain sensors available in the (active or non-active) vehicle or other mobile asset for a specific acquisition or measurement purpose.

Further, a network interconnecting a number of non-active (and/or active) vehicles/mobile assets is also contemplated by the invention. For example, a network of non-operating vehicles/mobile assets may be selectively activated and/or connected similar to or in the same way operational vehicles are connected in order to create virtual or actual V2V, V2I, V2C, V2P or V2E type network (e.g., VANET, MANET, DSRC or any suitable combination of these). In some embodiments, this may occur while certain assets are "dormant" or in a "sleep mode" based on network request. Such assets may remain substantially dormant with the exception of network participation. Such networks may also "hop" between mobile asset type (phone, drone, vehicle, etc.) in various active or "non-active" states in order to achieve the desired interconnection or communication pathway. For example, a non-active vehicle may acquire information that is passed along through the cloud or by other active (or nonactive) mobile asset such as phone, tablet, beacon etc.

For example, electronic beacons may exist throughout roadways that may periodically request and download such information. This may be accomplished using V2I (vehicle to infrastructure) or V2C (vehicle to cloud) communication links. Information requests may be, for example, law enforcement, traffic control or a driver or occupant of another vehicle/mobile asset. In the case of a traffic accident or other event of interest in the area, (e.g., in front of, to the side of, behind or otherwise nearby the user's vehicle,) a remote call may be issued by traffic control or law enforcement to upload the video record of all or some selected vehicles in the area in the hope to obtain information regarding the accident or event of interest such as traffic jam, fire, accident or other event. The information may include, for example, audio, any interaction with the involved vehicle(s), with other vehicles such as inter or intra-vehicle communication including all nearby vehicle telemetry, messages etc.

In other situations, an occupant or driver of one vehicle may request to observe images being recorded by another vehicle or mobile asset in the area, such as a vehicle or mobile phone a distance in front or behind the requesting vehicle. This may be done in the event of, for example, a traffic jam in front of the vehicle or to observe events occurring behind or to the side of the vehicle. These images may be transmitted to a display screen within the requesting vehicle, while in operation, to a mobile device in the vehicle, or from remote device such as a pc or tablet not resident in the vehicle.

Another aspect of the invention may involve V2P (vehicle to pedestrian) and/or P2I (pedestrian to infrastructure or cloud) interaction. Similar to the above, in the event of a detected (or impending) accident, a personal electronic device such as a nearby mobile phone or other recording device may be polled to seek the existence of potentially relevant information regarding the incident of interest stored in memory (or to record such on a going forward basis). Such information, in some embodiments, may be uploaded and analyzed/filtered for relevance.

For example, video and/or audio recordings, and/or telemetry, which may include past images of the impending (or actual) occurrence of interest, may be requested and retrieved. Relevance of such information may be determined by proximity, orientation and/or field of vision including the known sensory range and other technical capabilities of the recording device in addition to an image/audio/telemetry analysis of potential relevant information (which may be done locally or remotely).

Other relevant information may include audio recordings and/or personal or social media messages describing the incident and may also include telemetry information indicating position, orientation and capabilities of the recording device (e.g., was camera recording in the right direction to capture incident?). Further, in the event of an occurrence of interest, pedestrians nearby may be requested/instructed to approach and record the occurrence, which in some embodiments may include instruction or a remote emergency services application/attendant may take control of the device for a period of time and acquire information accordingly. This may be accomplished through a public service application resident on a mobile phone or network.

One aspect of the present invention may be further understood by considering the system 100 shown in FIG. 1. FIG. 1 depicts a road with five nearby cars (CARS 1-5 labeled as 102, 104, 106, 108 and 110 respectively) two pedestrians 121 and 125 and mobile associated assets/phones 123. As shown, each car may have a transmitter/receiver 103 for transmitting and/or receiving messages such as a cellular or wireless, DSRC or Wi-Fi link to and from nearby cars. Any suitable wireless link may be used if desired. Further, each vehicle may have cameras 105 installed as shown or in any similar suitable orientation to allow a sustainably full view of the surrounding area. In operation, a user of CAR 4 (108), may for example contact CAR 2 (104) through link 103 and interface 300 (shown in FIG. 3).

System 100 may also include beacons 115 that may wirelessly connect to the CARS 1-5 and mobile phones 123 and may provide network access. System 100 may periodically request (or request at specific times based on certain predetermined trigger events), information from the vehicles and mobile assets such as a video record from memory, call or communication logs and copy of messages or communications sent and received (txt, video audio, etc.) and/or telemetry information. This information may be requested by third parties such as traffic control or law enforcement, others such as parents relatives and owners and/or driver of the vehicle or mobile asset. Such a system may be useful for rental car companies or leased vehicles to determine vehicle history and operation. System 100 may store this information (in the vehicle in a control module or other network, (not shown)) and allow it to be accessed on a permission-based basis and at selected points in time.

As shown in FIG. 1, beacons 115 may connect mobile devices such as vehicles 102-110 and mobile phones 123 to network 131 (and to each other). In some embodiments, network 131 may be an Internet portal (and/or cellular portal) that provides general server-based access to the Internet and communication networks certain public sites such as NTSB, etc. that may be associated with traffic control. In other embodiments, network 131 may provide VPN or other private or partially network access for secure messaging, telemetry and video/audio sharing which may include law enforcement, a traffic control authority, insurance companies, rental companies and other private communications. Further, network 131 may, in some embodiments, be a secure, substantially dedicated network for sensitive applications such as Homeland Security, financial interactions, identity checks, unannounced monitoring or asset tracking etc. Further still, contemplated embodiments may incorporate some or all aspects of the above in order to best achieve the desired network functionality. Any suitable arrangement of network resources and known interconnections may be used, if desired.

Figure 2:
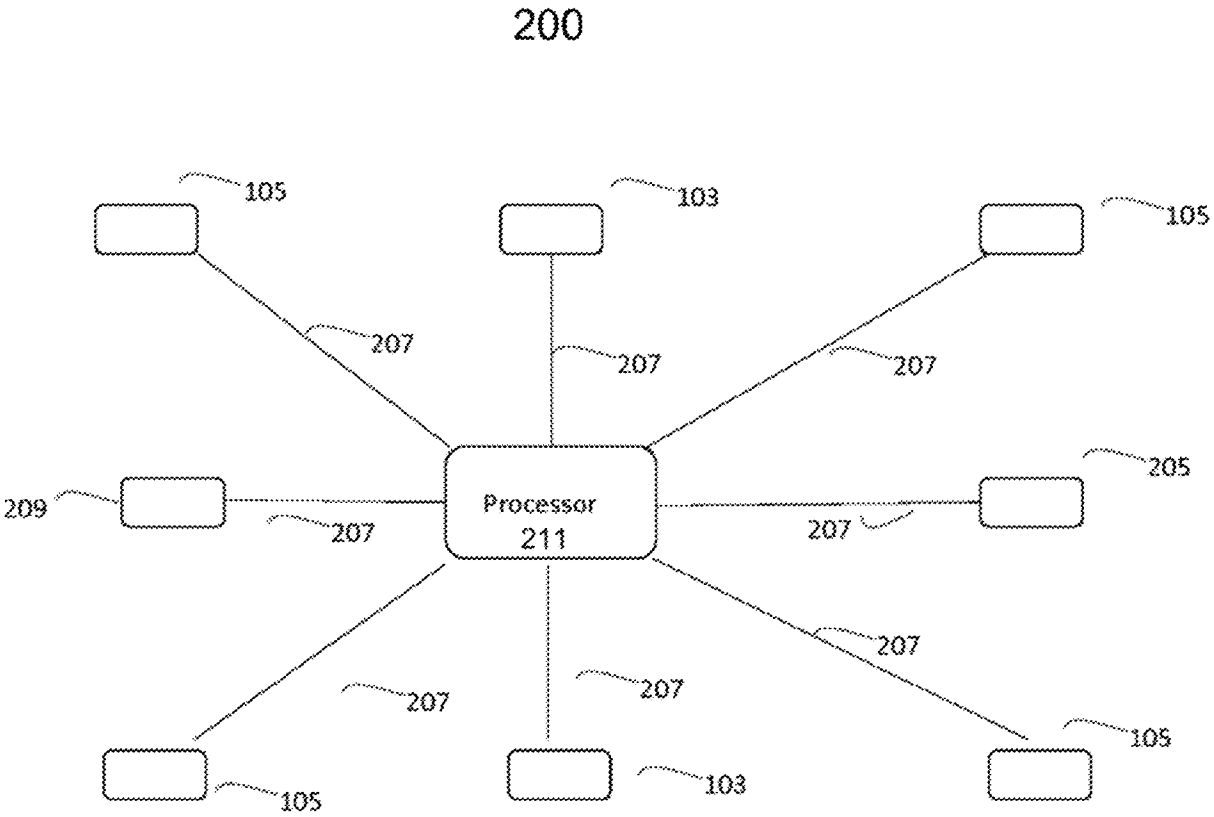
FIG. 2 is a block diagram of a vehicular mobile asset in accordance with an embodiment of the present invention.

FIG. 2 is a diagram of system 200 in accordance with one embodiment of the present invention. This system may be resident in the vehicle being traveled in such as e.g., CAR 4 (FIG. 1). As shown, system 200 may include cameras/sensors 105, transceivers 103, a memory 205, a user interface 209 and processor/computing unit 211. In other embodiments, processor 211 may be resident in the vehicle or may be a proxy or mobile device such as a cell phone, tablet or the like that can communicate with sensors 105 and transceivers 103 through any suitable hard-wired or wireless links 207. Further, in some mobile embodiments, memory 205 and/or interface 209 may be partially or fully resident in processing unit 211, which may be on a mobile tablet, mobile phone or laptop with a display interface. As mentioned above, this interface 300 (shown in FIG. 3) may be ported or hosted by the mobile computing device or to a display screen resident in the vehicle.

During vehicle operation, images, pictures, videos, telemetry and other information may be acquired by sensors 105 and processed, stored and controlled through user interface 209 memory 205 and processors 211. This may be done selectively, by user command or automatically when the vehicle is in operation (or selectively when it is not). Similarly, messages (txt, email, video, audio, etc.) may be composed and/or initiated and/or terminated through user interface 209 and transceivers 103 and stored partially or fully in memory 205 based on a pre-existing configuration or selectively based on user preference.

Figure 3:
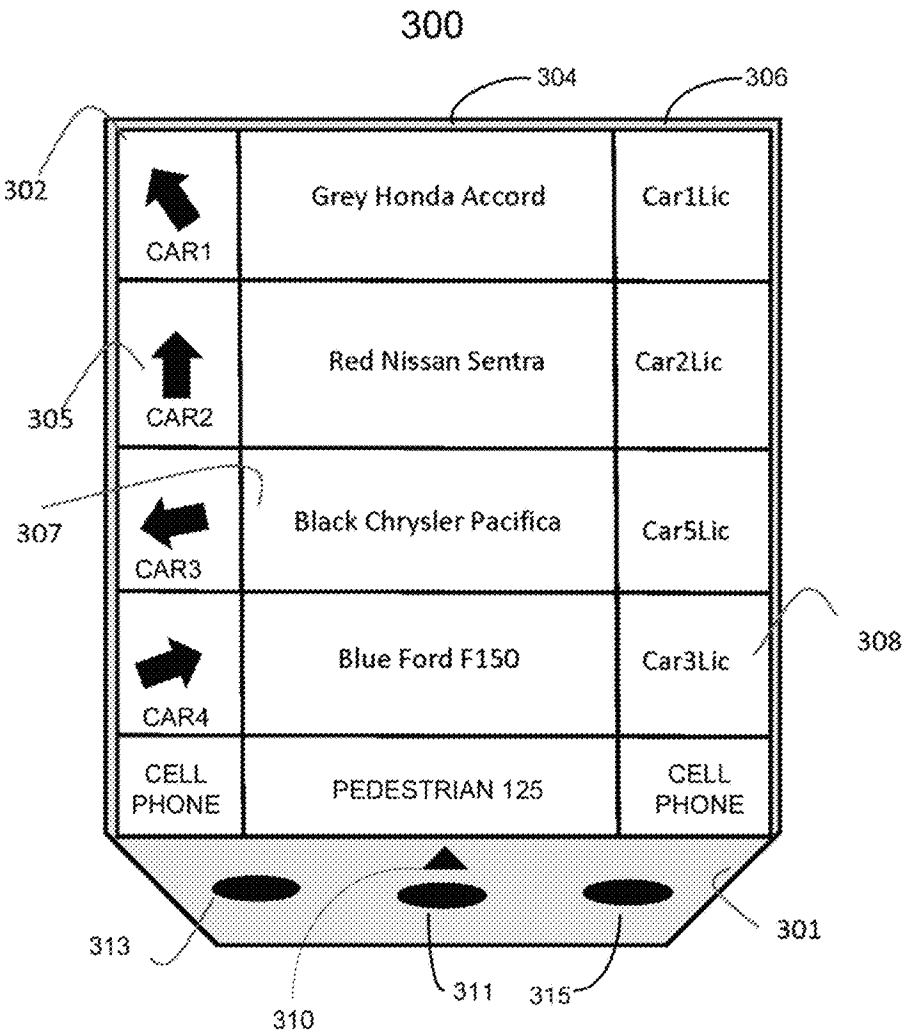
FIG. 3 shows an embodiment of a user interface constructed in accordance with an embodiment of the present invention.

One illustrative embodiment of interface 300 is shown in FIG. 3. It may be displayed on a display screen 301 installed in the vehicle ported to, or resident on mobile device (or any combination thereof). In operation, while driving, operative elements of system 100 and 200 may acquire information from nearby vehicles, pedestrian cell phone(s), or other mobile devices and display that information as shown. This may include vehicle/mobile device identification information in column 302, a description of the vehicle, or type of vehicle or mobile asset in column 304, and details regarding that vehicle/asset in column 306. Arrow 305 may indicate the relative position of the listed asset. A user may select one of these fields to select a vehicle or mobile asset of interest, initiate a communication with that vehicle/asset, and/or obtain more information about selected vehicle, asset and or user/occupant. This may be done using a touch screen technology or by using navigation buttons 310 and 311, select button 313 and/or info/initiate communication button 315.

Figure 4:
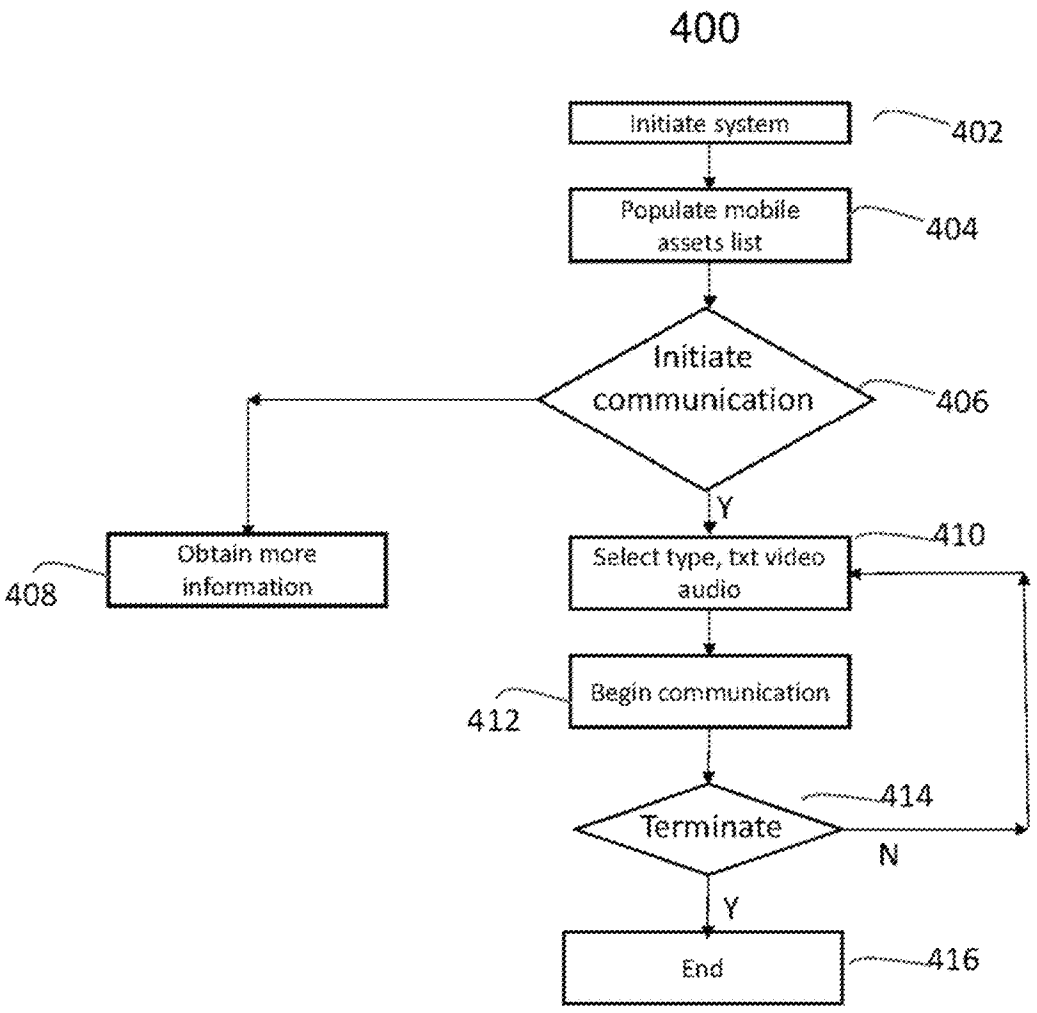
FIG. 4 is a flow chart illustrating some of the steps in accordance with one embodiment of the invention described herein.

Flow chart 400 of FIG. 4 illustrates some steps in the operation of the system described herein. System 100 or a particular mobile asset may be initialized at step 402 when it enters a network area or upon power up. Next a list of nearby vehicles/mobile assets may populate the list 300, at step 404. Such a list may also be available to pedestrians on mobile phones 123 through an application (not shown). A user may then select a vehicle/asset to communicate with at step 406. Next, the type of communication may be selected (txt, video, audio or combination thereof) at step 410. Next, the user may compose a message, share pictures video or other information and send to the selected vehicle, at step 412. This may be mediated through the system 100 and/or 200 through transceivers 103, interface 209 or a pre-existing wireless link of a interface in a mobile device (not shown). Optionally, the user may request more information at step 408 such as user identity, make of vehicle/mobile asset particulars, license plate number, identity, phone number etc. The displayed information may be dynamically selected on a use by use basis depending on user tendencies and/or programmed by vehicle/asset users or may be preselected information through initial configuration or set up procedure. In the case of video or audio communication, this information may be streamed or transmitted in substantially real time or near real time.

In some embodiments, the view of display 301 may be changed at user option to represent a substantially real-world view of the surrounding traffic pattern from a number of available perspectives depending on the point of view selected/desired by a user. One such point of view may be a substantially aerial view of the surrounding traffic pattern. This may be constructed from information obtained from other vehicles/mobile assets and may represent a picture based on relative vehicle/pedestrian velocity, vehicle density and other relevant data such as vehicle make and model to construct such a real-world representation. This may facilitate quick comprehension of vehicles/mobile assets of interest for a busy driver or an engaged pedestrian. With this embodiment, the user may select a vehicle/mobile asset with touch screen or using navigation keys. This may result in information similar to that in FIG. 3 to be displayed and allow a user to initiate communication with the selected vehicle/mobile asset as further described herein.

Another aspect of the invention may involve V2P (vehicle to pedestrian) and/or P2I (pedestrian to infrastructure or cloud) interaction. Similar to the above, in the event of a detected (or impending) collision, or other event of interest, a personal electronic device such as a nearby mobile phone or other recording device may be polled to seek the existence of potentially relevant information regarding the incident of interest.

For example, video and/or audio recordings, and/or relevant telemetry, which may include past images of the impending (or actual) occurrence of interest (and potentially its aftermath or progression), may be requested and retrieved/received. Relevance of such information may be determined by proximity, orientation and/or field of vision including the known sensory range, proximity and other technical capabilities of the recording device in addition to an image/audio/telemetry analysis of potential relevant information, which may be done locally or remotely).

One way relevant information may be determined/acquired is by analyzing and/or filtering information stored on nearby devices that have recordings in the area of interest. For example, some or all video/audio/messages, telemetry may etc. of nearby devices may be automatically uploaded to network and preserved based on a triggering event such as an accident and analyzed for relevance. In some embodiments, this may be based on time stamps of acquired information such that information acquired before a critical time may be ruled out initially. In some embodiments, such analysis may be done by remotely scanning each device for potentially relevant information which may involve a preservation command to prevent deletion of relevant information. In the case of attempted device destruction, or movement out of a specified area, potentially relevant information may be uploaded to a network or stored on a nearby mobile asset/device through V2V, V2P communications for future retrieval.

The systems described herein may also create a list of witnesses (vehicle, mobile phones and associated users etc.) that were nearby the incident of interest who can be contacted and questioned regarding their observations of any event of interest.

Other relevant information may include audio recordings and/or personal or social media messages describing the incident and may also include telemetry information indicating position, orientation and capabilities of the recording device (e.g., was camera recording in the right direction to capture incident?). Further, in the event of an occurrence of interest, pedestrians nearby may be requested/instructed to approach and record the event of interest, which in some embodiments may include receiving instructions or a remote emergency services application/attendant may take control of the device for a period of time and acquire information accordingly. This may be accomplished through a public service application resident on a mobile device (vehicle, phone) or network. Such an application may be downloaded automatically when a mobile device enters a certain area, when a nearby collision has been detected, or when it has been determined a nearby collision reasonably imminent. This may be based on server-side logic or communications issued to nearby assets from mobile assets that have collided or are at risk of imminent collision.

Figure 5:
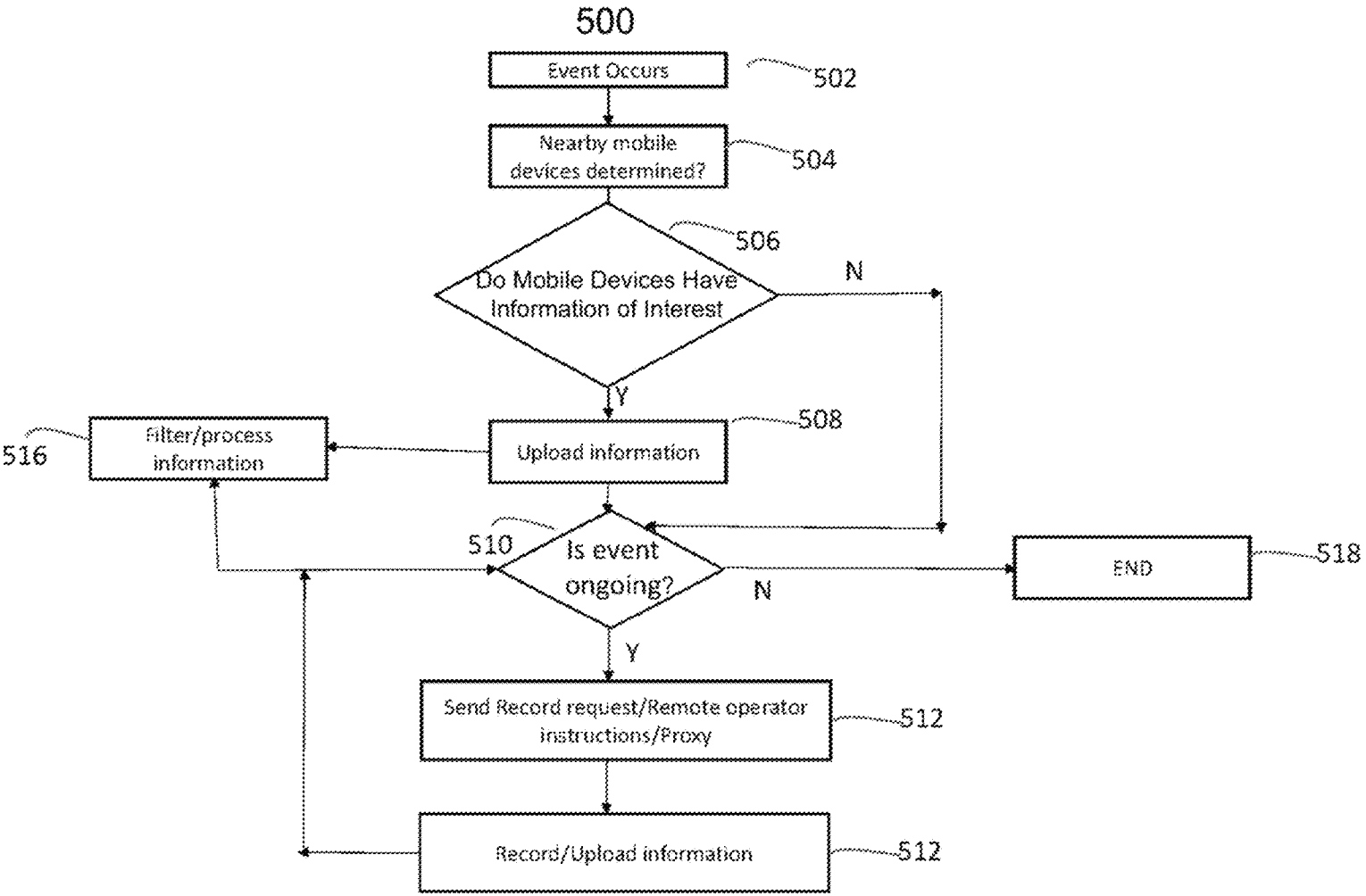
FIG. 5 is a flow chart illustrating some of the steps in accordance with one embodiment of the invention described herein.

Some of the steps that may be involved in conjunction with acquiring incident information in accordance with an aspect of the present invention is shown in FIG. 5. At the outset, devices of interest may be observed or otherwise known, tracked or registered with various infrastructure networks such as a mobile or cellular network or traffic control network which may include certain traffic and collision prediction capabilities.

As shown in flowchart 500 in FIG. 5, mobile assets within a certain area may be monitored for position, route and progress. This may involve tracking or monitoring any guidance being provided to mobile assets in a given area by a guidance system (e.g., from the cloud, network or within the device(s) themselves). At step 502, the system may determine or be informed that an event, such as a collision has occurred, or the system may determine that such is highly likely based on predictions from telemetry and guidance of the identified assets. In the event of an identified highly likely collision, a record request/command may be issued to nearby assets prior to event occurrence in an attempt to acquire pre- and post-event data and images. In some embodiments as further described herein, a collision may be confirmed by receiving confirmation from the involved assets that a collision has in fact been sensed by both (e.g., two or more of the involved) assets, and determine the severity of the impact.

Next, at step 504, after the event of interest has been identified/determined, nearby mobile devices/assets and their data acquisition capability may be determined. At step 506, such mobile assets may be polled to determine if they (already) have information of (potential) interest. If yes, that information may be uploaded to the network for review/analysis at step 508. This may involve filtering or processing such information at step 516 as is known in the art. If no, the system may determine if the event of interest is ongoing at step 510. If the event is ongoing, the system may send a record request or instructions to certain selected nearby asset(s) to obtain information at step 512. This may involve a remote operator or application taking control of the identified assets through proxy or other remote access and control application. At step 514 such recorded information may be uploaded in accordance with the request and may be filtered and processed at step 516.

In some embodiments, the inventions described herein may include multiple networks with varying capabilities that interoperate with each other on a predetermined or selected basis (e.g., cellular and traffic control, VANET, MANET 5 Ghz-6 Ghz frequency range, etc), Such networks may recognize the position of vehicles and/or mobile devices (mobile assets) within a certain area and may include certain telemetry information regarding each device such as speed, direction and, in some instances include monitoring the progress of vehicle and/or pedestrian from a navigation system or program (e.g., step 502, FIG. 5). Other information may include technical specifications of a recognized device such as model of vehicle or mobile pedestrian device such as cell phone, and sensory capture capability (audio, video, laser, radar, infrared, etc.) and recent/ongoing nature of any such recording activity of detected device(s)/vehicle(s).

In operation, the relative position and velocity (vector) of mobile assets may be monitored to determine proximity and the likelihood of a collision. This may be done in the cloud or by a network such as one operated by a traffic control or safety authority (V2I, P2I). In other embodiments, it may be done by the involved assets themselves through V2V or V2P connections. This may include assessing navigation guidance provided to a mobile asset that would predict the expected direction and velocity of the asset as well as reflect the periodic timing and status of certain traffic beacons such as traffic lights, stop signs, yield signs, congestion delays currently experienced in the current traffic pattern etc.

As proximity and direction begin to indicate possible collision with an increasingly higher degree of likelihood, various indicators may be sent to the involved mobile assets to apprize them of the situation. One example of this may be a "3-stage" system by which the involved assets are first 1) informed of the presence of other potentially conflicting asset(s), then 2) warning assets that unless action is taken collision may be imminent and then 3) hard action occurs such as a forced brake/evasive action to prevent collision.

For pedestrians, this may include a loud distinctive audio signal and/or forceful tactile warning to their mobile device which may indicate the direction of the threat based or type of tactile/audio warning provided. The threshold points at which such communications/actions are issued or taken may be static or may vary based on certain criteria such as weather, rate of speed of assets, the route of assets predicted by guidance systems in one or more asset(s), the history of problems such as collisions or near-misses in that area or particular spot, or the propensity or tendency of the involved asset(s) and or operators for near-misses or collisions in the same or similar circumstances, which may be monitored through a network, on the mobile assets themselves or a combination of both etc.

For example, assets first may be informed when proximity is ~250 feet, and a warning issued at ~150 feet and braking/evasive action mandated or forced at ~50 feet. Such thresholds may also be based on time to impact. For example, inform at 5 seconds from collision, warned at 3 seconds and braking at 1 second. These thresholds may be variable e.g., made longer in time or distance in conditions that would warrant such action such as bad weather or poor visibility or high rate of speed travel, or shorter in high-density city environments with lower travel speeds to prevent unnecessary warnings and evasive action, etc.

Further such warnings may reflect the "safety setting" for a particular vehicle with a certain operator such as a new, elderly or careless driver to account for inexperience or lagging reaction time. On the other end of the spectrum, such warnings may be removed or reduced to reflect driver skill and avoid unnecessary safety system interactions. Such settings may be automatically implemented (or suggested) and based on past or expected performance of such operators and may be further based on statistical norms for similarly situated operators. Such settings may also be manually set by vehicle owners such as parents guardians or rental companies and the like, which may receive electronic reports regarding the performance of such operators.

Further, in some embodiments, such warnings may be adaptive e.g., based on the "near-miss"/collision history of a vehicle, its operator or a mobile device and its associated pedestrian. For example, in a basic embodiment, the activity history of a mobile asset itself (vehicle, phone), may be analyzed to determine the type of actions/risk specific to that device (e.g., by a network application dedicated to such a task). In this case, if a driver has a propensity for a certain risk activity (e.g., speeding, unsafe maneuvering, tailgating) the warnings will adapt to compensate for or predict these tendencies/behavior). Such propensities may also be analyzed on the pedestrian side to provide adaptive warnings.

Moreover, in accordance with one aspect of the present invention, the occurrence of a collision may be detected and confirmed through information received from the mobile assets themselves. For example, in the case where a vehicle impacts another vehicle (a V2V impact), such impacts may be reported to a safety and/or traffic control network. In this instance, where two vehicles each report a collision at the substantially same spot and same/similar time, the likelihood that a collision has actually occurred is high. Thus, receiving a collision indication from one vehicle and the same or similar report from another vehicle may be viewed as a confirmation of a collision and emergency response may be dispatched as indicated. Such response may be based on the detected severity of the impact (shearing force of detected impact, force sensed by accelerometer or other MEMs device in vehicle/asset) biometric data from vehicle occupants as well as audio, video telemetry form the involved or nearby vehicles or pedestrians.

In other embodiments, vehicles involved in a collision may communicate with one another to confirm the collision among themselves and then send a collision detection report to a safety and/or traffic control network (V2V then V2I). Such a report may include vehicle and passenger ID, telemetry, nearby vehicles etc. Further, emergency response may be dispatched as indicated. This may also be based on the detected severity of the impact (shearing force of detected impact as sensed by accelerometer or MEMS device) biometric data, such as blood pressure pulse rate, etc from vehicle occupants as well as audio and video (one-way or two-way) from the involved or nearby vehicles or pedestrians.

A collision between a vehicle and a pedestrian (V2P impact) may be treated similarly. For example, in the case where a vehicle impacts a pedestrian, such impacts may be reported to a safety and/or traffic control network. In this instance, where the vehicle and a mobile asset associated with a pedestrian each report a collision at the substantially same spot and same time, the likelihood that a collision has actually occurred is high. Thus, receiving a collision indication from one vehicle and the same or similar report from a pedestrian device may be viewed as a confirmation of a collision. Further, in some embodiments, the vehicle and pedestrian device may communicate between one another to confirm the collision and report it to the network (e.g., through V2I, P2I communications or both) and emergency response may be dispatched as indicated (and polling of nearby devices for relevant information may begin as further described herein).

The type of emergency response may be based on the detected severity of the impact (shearing force of detected impact, as sensed by accelerometer or MEMS device) biometric data such as blood pressure, pulse rate, etc. from vehicle occupants and/or pedestrian as well as audio and video from the involved or nearby vehicles or pedestrians.

In any event, collision prevention techniques would normally detect nearby objects (including vehicles and pedestrians) and analyze their trajectory in relationship with the trajectory of the vehicle/asset to ascertain risk of an incident and avoid the incident by providing warnings to the driver and/or the pedestrian, and or automatically changing the vehicle movement (e.g., braking, reducing speed, changing direction and so forth). In the unfortunate event an incident would occur, the normal reporting procedures would provide feedback to eventually apply traffic management procedures (reducing speed limits, putting traffic signs, pavement markings, etc.) to reduce the likelihood of further incident.

In embodiments of the invention, traffic management and safety procedures may be applied not only responsive to actual reported collision incidents, but also responsive to close calls or near-misses. For example, referring to FIG. 1, CAR3 may detect pedestrian 125 and determine that pedestrian 125 and CAR3 are in danger of collision (illustrated by distressed pedestrian) and warnings may be issued to CAR3 and/or pedestrian 125 regarding the potential conflict. Such warning may recommend reduction in speed or altering of direction. The vehicle operator may accept or ignore such warnings. However, reports of such warnings, and whether they are accepted or not, and the outcome on the interaction may be sent to the network to a central server and analyzed as described below to improve traffic safety by adaptively changing the warnings issued to the involved assets, managing traffic flow, managing assets in the identified area etc. Further explanation of such analysis is provided below in connection with the analysis and corrective action that may be taken for so called "low margin" events.

In operation, CAR4 may detect that CAR2 is too close and respond by recommending/reducing its speed. CAR2 detects presence of pedestrian 121, but determines that although there is a potential conflict, there is no need to actually reduce speed. In certain embodiments, the vehicle control module reports such low margin situations to a central server. The reports may be accompanied by data such as location, proximity of nearby objects, speed of vehicles, lighting conditions, friction conditions, trajectories of involved vehicles and pedestrians, whether or not the driver was texting, talking on the phone, how loud music was etc.

In some embodiments, such reports may be properly anonymized/obscured to protect the driver (so the information that reporting vehicle was speeding or driver texting is not traceable back to the vehicle). Once a sufficient volume of reports is accumulated, it may be mined to ascertain "outliers"—higher risk locations, lower risk locations, and higher/lower risk drivers. Ascertained outliers can be further analyzed either automatically or with operator help to understand the actual pattern and cause of high risk situations and simulate possible intervention. For example, it might be desirable to install a traffic light, or reduce posted speed limit when road is wet or otherwise has a low friction coefficient, (e.g., with an adaptive speed limit warning electronically provided to driver). Further, operator may be advised that his performance is unusually lower during dark hours (meaning that he may need to wear corrective glasses or has poor night vision), or that he has unusually high number of close calls during lane change (meaning that he likely needs to be more careful during such maneuvers or needs to be reminded to check blind spot sensors).

In any event, collision prevention and warning techniques described herein detect nearby objects (including vehicles and pedestrians) and analyze their trajectory in relationship with the trajectory of other such mobile assets to ascertain the risk of an incident and preferably avoid the incident by providing warnings to the driver and/or the pedestrian, and or automatically changing the vehicle movement if necessary (e.g., braking, reducing speed, changing direction and so forth). In the unfortunate event an incident occurs, the normal reporting procedures would provide feedback to eventually apply traffic management procedures (reducing speed limits, putting traffic signs, pavement markings, etc.) to reduce the likelihood of further incident.

However, in the event that action is taken to avoid an impending impact such as by forced deceleration and/or trajectory modification, a collision avoidance protocol may be implemented in several different ways. For example, with the recent advent of automatic transmissions that may shift rapidly (in the millisecond range e.g., 100-200 ms), it may be desirable to downshift to a specific low gear prior to the application of brakes to convert as much of the kinetic energy of the vehicle as possible to the rotational energy in the transmission drivetrain thereby reliably slowing the vehicle down and reducing the stress on the brakes when applied so the vehicle may stop more quickly and effectively.

For example, in the case where a collision is deemed imminent and a forced braking is indicated (e.g., one second prior to impact) a forced downshift may occur (taking ~150 ms). After the downshift has occurred (e.g., at ~850 ms prior to impact), and kinetic energy for the vehicle forward motion has largely been placed on the drivetrain gearbox, the brake may be automatically engaged somewhat after (e.g., at ~500 ms prior to impact or as mandated) allowing the brakes to act more effectively in slowing or stopping the vehicle. Such downshift may automatically occur to the substantially lowest gear in the transmission allowing for maximum deceleration and offloading of kinetic energy to the greatest extent possible. Further, in some embodiments, vehicle may have a "special" or substantially dedicated "braking/deceleration gear" that is not used in the normal operation of the car but is used in emergency situations to provide maximum deceleration. In vehicle embodiments that have adjustable or programmable gearing, downshifting to the lowest or near lowest possible gear to prevent wheel lock may occur, with the particulars of such downshifting being dynamically determined and applied (commanded) based on the specifics (wheel friction coefficient, distance to impact, speed, etc.) of a certain driving or breaking scenario.

In certain embodiments contemplated by the present invention, traffic management procedures and corrective action may be based on and responsive to detection and analysis of "near-miss" events, that is, collisions that were detected as possible but were avoided and/or their risk minimized by the various impact warning systems described herein. This may include voluntary action by the driver or pedestrian based on an issued warning (in a low or emerging threat situation) or forced action or intervention by an anti-collision system in a high threat situation. Some or all such events and their associated severity may be reported to the network through V2I and P2I communications. Such information may then be analyzed server-side to provide customized warnings in certain areas to mobile assets based on the event history in that area to improve/optimize safety and traffic flow. Further, high risk locations, low risk locations, and higher/lower risk drivers may be identified. Such warnings may be based on traffic patterns when they reach certain thresholds or change dynamically based on various known metrics such as for certain times of day (rush hour, late night, etc.) to best react to current or sensed conditions and associated risks.

Furthermore, traffic flow patterns such as traffic signal timing, speed limits, intersection management and design may also be adopted and implemented. Such changes may also be dynamic in nature based on sensed traffic flow and may be implemented in near real time to address sensed congestion or safety problems or in view of a certain event of interest such as an accident, broken-down vehicle, etc. Further, for example, speed limit changes may be broadcast to vehicles within a certain area to account for bad weather, low friction coefficients or poor visibility. Another example would be the case of a traffic signal malfunction or power outage. In this case, virtual traffic signals may be provided to mobile assets in the affected area through messages, a centralized traffic control application or control signals from central server or mediated and agreed upon by the vehicles themselves based on V2V, V2I, V2P or other suitable connection and received by vehicles in the affected area. Such a program may be resident in the control module of a vehicle to allow vehicles themselves to orderly traverse intersections based on substantially direct V2V communication. Thus, although the traffic light may be out or malfunctioning, traffic can flow substantially normally based on such communication and interaction. In some embodiments, prospective scenarios may be mathematically modeled and may be periodically tested and validated in real-world situations prior to formal adoption or to comply with local regulation.

Vehicle side scenario. In embodiments known in the art, collision prevention means may detect unsafe vehicle proximity during a passing maneuver. In this instance, the vehicle's computer recognizes the low-margin event, the vehicle location, associated driving conditions and approximate locations/moving vectors of nearby vehicles. In one embodiment, the event information would be sent to the server almost immediately after the event in near real time. In another embodiment, information about low-margin events may be accumulated on the vehicle computer and sent to the server as time/connectivity permits (e.g, when vehicle is connected to a wireless Internet network). After optional depersonalization (e.g., removing the exact day/time of the events, but keeping the day of the week and hour), server-side logic may store the events in a mineable database. Commercially available data mining software, such as SAS or IBM Cognos may be used to periodically analyze the data and provide improvement suggestions.

Similar such information as described above and herein may be obtained from mobile phones to monitor pedestrian traffic and tendencies. Such information may be very useful in crowded or emergency situations to guide pedestrians along safe routes or exits from buildings or venue or other areas keeping in mind hazards, pedestrian safety and the general desire for an expeditious and orderly exit. In such embodiments, the location of the asset may be determined, and routes of exit calculated based on known navigational system techniques. Further, routes may be suggested (or mandated) based on input or parameters defined by venue safety or law enforcement officials or authorities. For example, safety first, expeditious exit next, or vice versa, etc. Such routes may be displayed automatically on a phone or vehicle in the event or an emergency or forced evacuation (e.g., based on venue safety and evacuation applications and protocols). Loud and or distinctive tactile alerts may be issued along with emergency guidance instruction and the ability to request help, locate medical attention and estimate time to safe exit of venue and to contact family members after safe exit.

Data may be further analyzed to develop a conditional probabilities of occurrence of low margin events (e.g., using known and accounted for in traffic engineering parameters such as day of the week, time, season, traffic volume, speed, etc). Once such probabilities are derived, data mining software may be used to discover "outliers"—areas where low margin events occur with observed frequencies that generally cannot be predicted by computed probabilities—meaning that there is a unknown factor making a particular location (or a particular driver, or vehicle model) more or less prone to near-miss incidents. Such statistical outliers, and generally detected areas with either high or low probabilities are dealt with (potentially with help of a human operator) to see what can be done to reduce the risk, or on the alternative, to improve traffic flow in low risk areas.

In some embodiments, the known in the art collision prevention means in the vehicle detected a low margin scenario, for example the vehicle cut off another vehicle while changing lanes. As described above, the event may be reported to the server side logic in an anonymized form. In addition, the log of such events is kept on the vehicle computer. In one embodiment, the vehicle computer receives from server side logic conditional probability model to predict the low margin event and use this model to see how observed frequencies for this vehicle (or particular driver) aligned with the probability model. For example, the probability model would suggest that average driver driving in particular area and times of the day, would cut off another driver once per 16 hours of driving time. For example, however, the vehicle computer detected 19 such events for 20 hours of driving time. That may indicate the driver at particularly high risk for preforming a dangerous or otherwise inadvisable maneuver. The vehicle computer may detect this and so advises the driver.

In another embodiment, the data on the server side is not anonymized and analysis occurs on the server side. In this case, the results of the analysis would be provided to driver or vehicle owner either though vehicle computer that would receive the analysis from the network, or by email or any other suitable communication media. In the embodiments, the analysis and/or statistics about low margin events can also be provided to insurance companies and/or law enforcement agencies (subject to proper legal/privacy safeguards or further anonymization).

It will be understood that these steps are merely illustrative, and are not meant to be comprehensive or necessarily performed in the order shown. Persons skilled in the art will appreciate that the present invention can be practiced by other than the described embodiments, which are presented for purposes of illustration rather than of limitation, and the present invention is limited only by the claims which follow.

What is claimed is:

1. A system for determining whether one or more mobile assets have been involved in a collision, comprising:

a cloud-based server configured to receive a collision detection message from a plurality of mobile assets, wherein the a cloud-based server receives a first collision detection message from a first mobile asset and a second collision detection message from a second mobile asset; and comparing the first collision detection message and the second collision detection message to determine whether the first mobile asset and second mobile asset have likely collided, wherein the first mobile asset is a vehicle and the second mobile asset is a mobile phone associated with a pedestrian.

2. The system of claim 1 wherein the comparing further comprises comparing a location information associated with the first collision detection message and the second collision detection message.

3. The system of claim 1 wherein the comparing further comprises comparing a time of collision occurrence information associated with the first collision detection message and the second collision detection message.

4. The system of claim 1 wherein the first mobile asset and the second mobile asset communicate to determine whether a collision has occurred between the first mobile asset and the second mobile asset.

5. The system of claim 4 wherein the first mobile asset or the second mobile asset send an accident report to the cloud based server based on communication between first and the second mobile asset to determine that the collision has occurred.

6. The system for claim 1 wherein the first collision detection message and the second collision detection message are generated based on readings acquired from a first sensor in first mobile asset and a second sensor in the second mobile asset.

7. The system of claim 6 wherein the cloud-based server generates a message requesting emergency services based at least in part on the severity of an impact detected by the second sensor.

8. The system of claim 1 wherein the cloud-based server requests emergency services based at least in part or a determination that a collision has likely occurred and on biometric data received from the first or second mobile asset involved in the collision.

9. The system of claim 1 wherein when a determination is made that a collision has likely occurred, at least some nearby mobile devices are polled to identify potentially relevant information regarding the collision.

10. The system of claim 1 wherein when a determination is made that a collision has likely occurred, potentially relevant information regarding the collision is transferred from nearby mobile devices.

11. The system of claim 10 wherein the potentially relevant information is analyzed to determine how or why the collision occurred.

12. A system for reducing likelihood of mobile asset collision, the system comprising: a first plurality of mobile assets, wherein each of in the first plurality of mobile assets in the first plurality of mobile assets includes a sensor from a first plurality of sensors; a second plurality of mobile assets, wherein each of the mobile assets in the second plurality of mobile assets includes a sensor from a second plurality of sensors; a cloud-based server wirelessly coupled to the first plurality of mobile assets, the cloud-based server coupled to a navigational application program component configured to monitor a relative position of the mobile assets in the first plurality of the mobile assets to determine a likelihood of collision, and wherein the cloud-based server issues a warning to a first subplurality of mobile assets to advise of a determined collision threat, wherein the cloud-based server is wirelessly coupled to the second plurality of mobile assets, the cloud-based server further configured to monitor a relative positions of the first and second plurality of mobile assets with the navigational application program component, to determine a likelihood of collision, and wherein the cloud-based server issues a warning to a second subplurality of mobile assets which includes mobile assets from the first and second pluralities to advise of a determined collision threat.

13. The system of claim 12 wherein the first plurality of mobile assets include cars or trucks.

14. The system of claim 12 wherein the determined collision threat is based, at least in part, on a proximity of the first plurality of mobile assets to other mobile assets or stationary objects.

15. The system of claim 14, wherein statistical information from a multiplicity of near collision events is used to provide feedback to an operator or an owner of at least one mobile asset in the first plurality, the information about the multiplicity of near collision events being derived information from the first plurality of sensors.

16. The system of claim 14, wherein statistical information from multiplicity of near collision event is used to improve traffic management of location, the information about the multiplicity of near collision events was derived based on information from the first plurality sensors.

17. The system of claim 14, wherein statistical information from a multiplicity of near collision events is used to provide feedback to an operator or an owner of at least one mobile asset in the second plurality, the information about the muliplicity of near collision events being derived information from the second plurality of sensors.

18. The system of claim 12 wherein the determined collision threat is based, at least in part, on route predictions calculated by the navigational application program component.

19. The system of claim 18 wherein the determined collision threat is based, at least in part, on a velocity of at least one mobile asset or on input from a traffic beacon.

20. The system of claim 12 wherein the second plurality of mobile assets includes mobile phones associated with pedestrians.

21. The system of claim 12 wherein the determined collision threat is based, at least in part, on proximity of the second subplurality of mobile assets to other mobile assets or stationary objects.

22. The system of claim 12 wherein the determined collision threat is based, at least in part, on route predictions calculated by the navigational application program component.

23. The system of claim 22, wherein statistical information from a multiplicity of near collision events is used to improve traffic management of a location, the information about the multiplicity of near collision events was derived based on information from the second plurality of sensors.

24. The system of claim 12 wherein the determined collision threat is based, at least in part, on a velocity of at least one mobile asset or on input from traffic beacons.

25. The system of claim 12 wherein the determined collision threat is based, at least in part, from sensors of the involved assets.

* * * * *